US009671176B2

(12) United States Patent
Johnson et al.

(10) Patent No.: US 9,671,176 B2
(45) Date of Patent: Jun. 6, 2017

(54) HEAT EXCHANGER, AND METHOD FOR TRANSFERRING HEAT

(75) Inventors: Mark Johnson, Racine, WI (US); Bradley Engel, Waterford, WI (US)

(73) Assignee: Modine Manufacturing Company, Racine, WI (US)

( * ) Notice: Subject to any disclaimer, the term of this patent is extended or adjusted under 35 U.S.C. 154(b) by 831 days.

(21) Appl. No.: 13/585,934

(22) Filed: Aug. 15, 2012

(65) Prior Publication Data

US 2013/0306272 A1 Nov. 21, 2013

Related U.S. Application Data

(60) Provisional application No. 61/649,046, filed on May 18, 2012.

(51) Int. Cl.
*F28F 1/10* (2006.01)
*F28D 1/04* (2006.01)
(Continued)

(52) U.S. Cl.
CPC ..... *F28F 1/10* (2013.01); *F25B 13/00* (2013.01); *F25B 39/00* (2013.01); *F28D 1/0417* (2013.01); *F28D 1/0435* (2013.01); *F28D 1/05341* (2013.01); *F28F 1/022* (2013.01); *F28F 1/126* (2013.01); *F25B 2313/02741* (2013.01)

(58) Field of Classification Search
CPC .... F28D 1/0417; F28D 1/0435; F28D 1/0452; F28D 1/05333; F28D 7/0083; F28D 1/05341; F28F 1/022; F28F 1/10; F28F 1/00; F28F 2215/04; F28F 2210/04;
(Continued)

(56) References Cited

U.S. PATENT DOCUMENTS 2,307,298 A 1/1943 Przyborowski
3,738,117 A 6/1973 Engel
(Continued)

FOREIGN PATENT DOCUMENTS

CN 1292485 4/2001
CN 1590925 3/2005
(Continued)

OTHER PUBLICATIONS

PCT/US2013/023657 International Search Report and Written Opinion dated Sep. 5, 2013 (9 pages).
(Continued)

*Primary Examiner* — Tho V Duong
(74) *Attorney, Agent, or Firm* — Michael Best & Friedrich LLP

(57) ABSTRACT

A heat exchanger is provided to efficiently transfer heat between air and a flow of refrigerant in a reversing air-sourced heat pump system. When the system is operating in heat pump mode, a flow of air is directed through the heat exchanger and is heated by the refrigerant. A portion of the flow of air is prevented from being heated by the refrigerant in a first section of the heat exchanger, and is used to sub-cool the refrigerant in another section of the heat exchanger after the remaining air has been heated by the refrigerant. The same heat exchanger can be used to cool a flow of air using expanded refrigerant when the system is operating in an air conditioning (cooling) mode.

11 Claims, 7 Drawing Sheets

Counter Flow Operation

(51) Int. Cl.

| | |
|---|---|
| ***F28F 1/02*** | (2006.01) |
| ***F28F 1/12*** | (2006.01) |
| ***F25B 13/00*** | (2006.01) |
| ***F25B 39/00*** | (2006.01) |
| ***F28D 1/053*** | (2006.01) |

(58) Field of Classification Search
CPC ..... F28F 2210/08; F28F 1/126; F25B 39/00; F25B 2313/02741; F25B 13/00
USPC ..... 165/104.13, 140, 48.1, 172, 151
See application file for complete search history.

(56) References Cited

U.S. PATENT DOCUMENTS

| | | | | |
|---|---|---|---|---|
| 4,434,841 | A | 3/1984 | Jackson et al. | |
| 5,176,200 | A * | 1/1993 | Shinmura | 165/144 |
| 5,267,610 | A | 12/1993 | Culbert | |
| 5,279,360 | A | 1/1994 | Hughes et al. | |
| 5,509,272 | A | 4/1996 | Hyde | |
| 5,529,116 | A * | 6/1996 | Sasaki | F28D 1/0417 123/41.51 |
| 5,743,328 | A * | 4/1998 | Sasaki et al. | 165/144 |
| 6,026,893 | A | 2/2000 | Jung | |
| 6,170,565 | B1 | 1/2001 | Nishishita | |
| 6,189,604 | B1 * | 2/2001 | Yamauchi et al. | 165/140 |
| 6,745,827 | B2 | 6/2004 | Lee | |
| 2004/0154331 | A1 | 8/2004 | Horiuchi | |
| 2005/0011637 | A1 * | 1/2005 | Takano | 165/144 |
| 2005/0109485 | A1 * | 5/2005 | Kolb et al. | 165/42 |
| 2007/0267186 | A1 | 11/2007 | Heckt | |
| 2007/0277964 | A1 | 12/2007 | Higashiyama | |
| 2008/0110603 | A1 * | 5/2008 | Fellague et al. | 165/140 |
| 2008/0173434 | A1 | 7/2008 | Matter | |
| 2009/0056916 | A1 | 3/2009 | Yesin et al. | |
| 2011/0139414 | A1 * | 6/2011 | Ghosh et al. | 165/151 |
| 2011/0139425 | A1 | 6/2011 | Beamer | |

FOREIGN PATENT DOCUMENTS

| | | | | |
|---|---|---|---|---|
| CN | 1629590 | | 6/2005 | |
| CN | 1723378 | | 1/2006 | |
| CN | 101600919 | | 12/2009 | |
| DE | 2149548 | | 4/1972 | |
| EP | 1298401 | | 4/2003 | |
| EP | 1519133 | A2 * | 3/2005 | |
| EP | 2037201 | | 3/2009 | |
| FR | 2804206 | | 7/2001 | |
| FR | 2804206 | A1 * | 7/2001 | F28F 1/24 |
| JP | 03-95368 | | 4/1991 | |
| JP | 2001028529 | | 1/2001 | |
| JP | 2001336896 | | 12/2001 | |
| JP | 2002122966 | | 4/2002 | |
| JP | 2003084395 | | 3/2003 | |
| JP | 2004225961 | | 8/2004 | |
| JP | 2006052882 | | 2/2006 | |
| JP | 2009079781 | | 4/2009 | |
| WO | 2007037670 | | 4/2007 | |
| WO | 2011136047 | | 11/2011 | |

OTHER PUBLICATIONS

PCT/US2013/023657 International Preliminary Report on Patentability dated May 21, 2014 (12 pages).
Notification of the First Office Action from The State Intellectual Property Office of the People's Republic of China for Application No. 201380026065.7 dated Jan. 28, 2016 (18 pages).
Notice of First Office Action from The State Intellectual Property Office of the People's Republic of China for Application No. 201310054363.9 dated May 26, 2016 (21 pages).
Office Action from the United States Patent and Trademark Office for U.S. Appl. No. 14/076,681 dated Jun. 14, 2016 (17 pages).
Office Action from the United States Patent and Trademark Office for U.S. Appl. No. 14/399,308 dated Jun. 14, 2016 (13 pages).
Second Office Action from The State Intellectual Property Office of the People's Republic of China for Application No. 201380026065.7 dated Sep. 21, 2016 (23 pages).
Office Acton from the Japanese Intellectual Property Office for Application No. 2012-194930 first known to us Oct. 3, 2016 (23 pages).
Second Office Action from The State Intellectual Property Office of the People's Republic of China for Application No. 201310054363.9 dated Jan. 13, 2017 (17 pages).

* cited by examiner

Counter Flow Operation

Concurrent Flow Operation

HEAT EXCHANGER, AND METHOD FOR TRANSFERRING HEAT

CROSS REFERENCE TO RELATED APPLICATIONS

This application claims priority to U.S. Provisional Application No. 61/649,046, filed May 18, 2012, the entire contents of which are hereby incorporated by reference herein.

BACKGROUND

The present application relates generally to heat exchangers and methods for transferring heat between fluids, and more specifically, relates to heat exchangers and heat transfer in refrigerant systems.

Vapor compression systems are commonly used for refrigeration and/or air conditioning and/or heating, among other uses. In a typical vapor compression system, a refrigerant, sometimes referred to as a working fluid, is circulated through a continuous thermodynamic cycle in order to transfer heat energy to or from a temperature and/or humidity controlled environment and from or to an uncontrolled ambient environment. While such vapor compression systems can vary in their implementation, they most often include at least one heat exchanger operating as an evaporator, and at least one other heat exchanger operating as a condenser.

In systems of the aforementioned kind, a refrigerant typically enters an evaporator at a thermodynamic state (i.e., a pressure and enthalpy condition) in which it is a subcooled liquid or a partially vaporized two-phase fluid of relatively low vapor quality. Thermal energy is directed into the refrigerant as it travels through the evaporator, so that the refrigerant exits the evaporator as either a partially vaporized two-phase fluid of relatively high vapor quality or a superheated vapor.

At another point in the system the refrigerant enters a condenser as a superheated vapor, typically at a higher pressure than the operating pressure of the evaporator. Thermal energy is rejected from the refrigerant as it travels through the condenser, so that the refrigerant exits the condenser in an at least partially condensed condition. Most often the refrigerant exits the condenser as a fully condensed, subcooled liquid.

Some vapor compression systems are reversing heat pump systems, capable of operating in either an air conditioning mode (such as when the temperature of the uncontrolled ambient environment is greater than the desired temperature of the controlled environment) or a heating mode (such as when the temperature of the uncontrolled ambient environment is less than the desired temperature of the controlled environment). Such a system may require heat exchangers that are capable of operating as an evaporator in one mode and as a condenser in an other mode.

In some systems as are described above, the competing requirements of a condensing heat exchanger and an evaporating heat exchanger may result in difficulties when one heat exchanger needs to operate efficiently in both modes.

SUMMARY

According to an embodiment of the invention, a heat exchanger is provided to transfer heat between refrigerant and a flow of air. The heat exchanger includes a refrigerant flow path that extends between two refrigerant ports. Three sections of the heat exchanger are arranged along the refrigerant flow path. One air flow path extends sequentially through a first section adjacent to one of the refrigerant ports, and a second section adjacent to the other refrigerant port, while bypassing the third section. Another air flow path in parallel with the first air flow path extends through only the third section.

In some embodiments, the refrigerant flow path includes at least two passes through the third section. In some such embodiments the refrigerant flows through those passes in a concurrent-cross flow relationship with the air.

In some embodiments, the two air flow paths include extended surface features to promote heat transfer between the air and the refrigerant, and in some such embodiments the spacing density of the extended surface features is substantially lower in the first section than in the third section. In some such embodiments the first section is substantially absent of extended surface features.

In some embodiments, the refrigerant flow path is defined by flattened tubes in one or more of the section. In some such embodiments, at least some of the flattened tubes are continuous between the first section and at least one pass of the third section. In some such embodiments at least some of the flattened tubes are continuous between the second section and at least one pass of the third section.

According to an embodiment of the invention, a method of removing heat from a refrigerant includes separating a flow of air into first and second portions. A first quantity of heat is transferred from the refrigerant to the first portion of air, and a second quantity of heat is transferred to the first portion of air after the first quantity of heat. After the first and second quantities of heat have been removed from the refrigerant, a third quantity of heat is transferred from the refrigerant to the second portion of air. The heated first and second portions of air are then recombined.

In some embodiments, the refrigerant is de-superheated and condensed by the removal of the first and second quantities of heat. In some such embodiments the refrigerant is sub-cooled by the removal of the third quantity of heat.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1A:
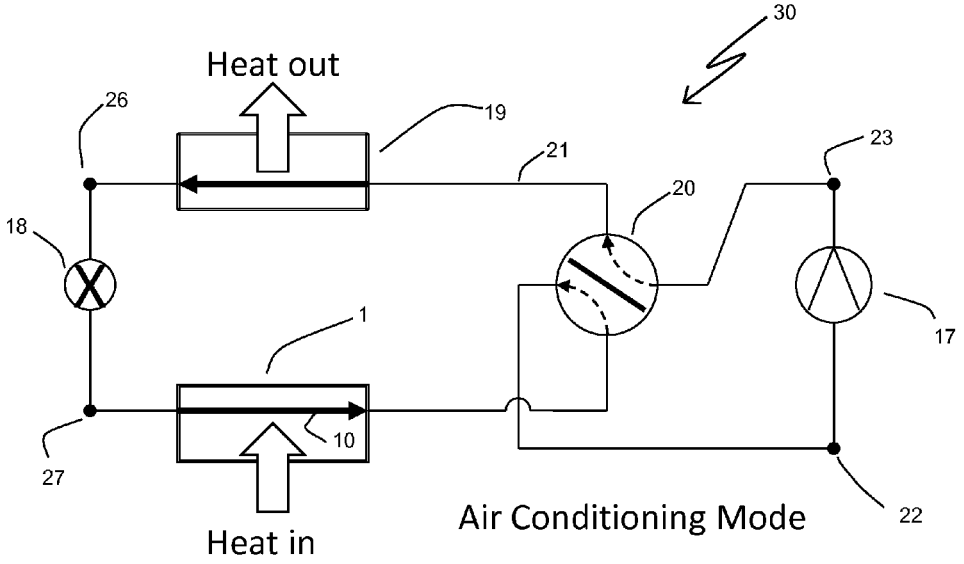
FIGS. 1*a* and 1*b* are schematic illustrations of a refrigerant system operating in an air conditioning mode and a heating mode, respectively.
Figure 1B:
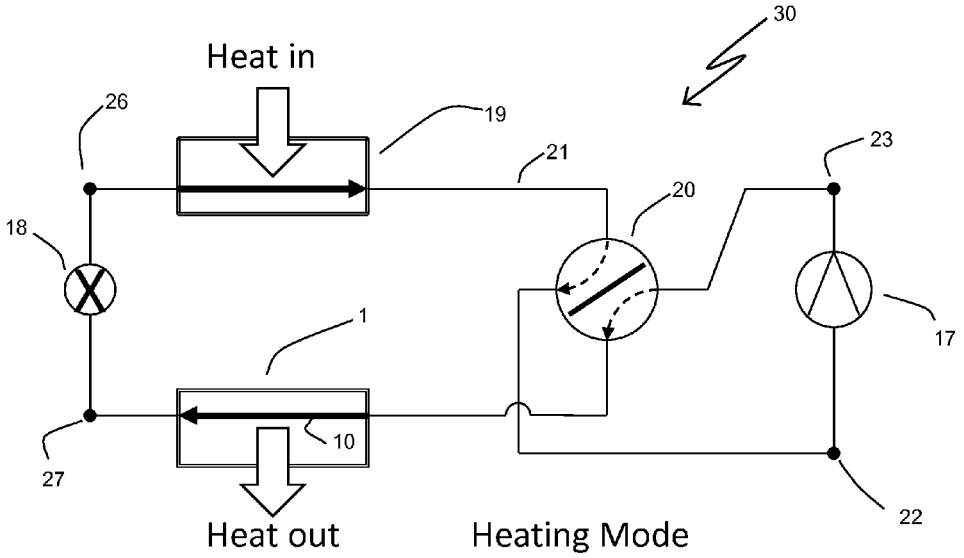

A reversible heat pump system 30 capable of operating in either of an air conditioning mode and a heating mode is illustrated schematically in FIGS. 1*a* and 1*b*, and includes a compressor 17, an expansion device 18, first and second heat exchangers 1 and 19, and a four-way valve 20. A refrigerant circuit 21 interconnects the various components to define a closed loop refrigerant circuit through the system.

During operation of the system 30 in an air conditioning mode, as illustrated in FIG. 1*a*, the compressor 17 operates to direct a flow of refrigerant through the circuit 21 by compressing a superheated vapor refrigerant from a low pressure state, at point 22 in the system, to a high pressure state, at point 23 in the system. The compressed vapor refrigerant is directed by way of the four-way valve 20 to heat exchanger 19, which operates to reject heat from the refrigerant. The heat exchanger 19 can be preferably located in an environment that does not need to be controlled. For example, the heat exchanger 19 can be located external to a building so that the rejected heat is discharged to the ambient environment. Alternatively, the heat exchanger 19 can reject the heat from the refrigerant to another fluid such as, for example, a liquid coolant, in order to transport the rejected heat to another location.

With continued reference to FIG. 1*a*, the heat exchanger 19 preferably cools and condenses the refrigerant from the superheated vapor state to a sub-cooled liquid state. The expansion device 18 expands the refrigerant from that high pressure sub-cooled liquid state, at point 26 in the system, to a low pressure two-phase (vapor-liquid) state, at point 27 in the system. The low pressure two-phase refrigerant is directed into heat exchanger 1, wherein heat is transferred to the refrigerant in order to fully vaporize, and preferably superheat, the refrigerant. The refrigerant exiting the heat exchanger 1 is then directed by way of the four-way valve 20 back to the inlet of the compressor 17.

The heat transferred into the refrigerant in the heat exchanger 1 is preferably transferred from a flow of supply air directed through the heat exchanger 1. The supply air can thereby be cooled and/or dehumidified, and can be supplied to an occupied space in order to provide climate comfort in that space.

The system 30 can also be operated in a heating mode, illustrated in FIG. 1*b*, when conditions dictate that the supply air should be heated. The four-way valve 20 is adjusted so that the compressed refrigerant at point 23 is directed by way of the four-way valve 20 to the heat exchanger 1. Heat is removed from the superheated compressed refrigerant in the heat exchanger 1, so that the refrigerant exits the heat exchanger 1 in a sub-cooled liquid state. As will be discussed further on in greater detail, in heating mode the refrigerant passes through a refrigerant flow path 10 of heat exchanger 1 in opposite direction of the flow through that flow path when operating in air conditioning mode.

With continued reference to FIG. 1*b*, the refrigerant is again expanded by the expanded 18 from the high pressure sub-cooled liquid state at point 26 to a low pressure two-phase (vapor-liquid) state at point 27. The refrigerant is next directed through the heat exchanger 19, wherein it receives heat in order to fully vaporize, and preferably superheat, the refrigerant. The refrigerant exiting the heat exchanger 19 is then directed by way of the four-way valve 20 back to the inlet of the compressor 17.

Figure 2:
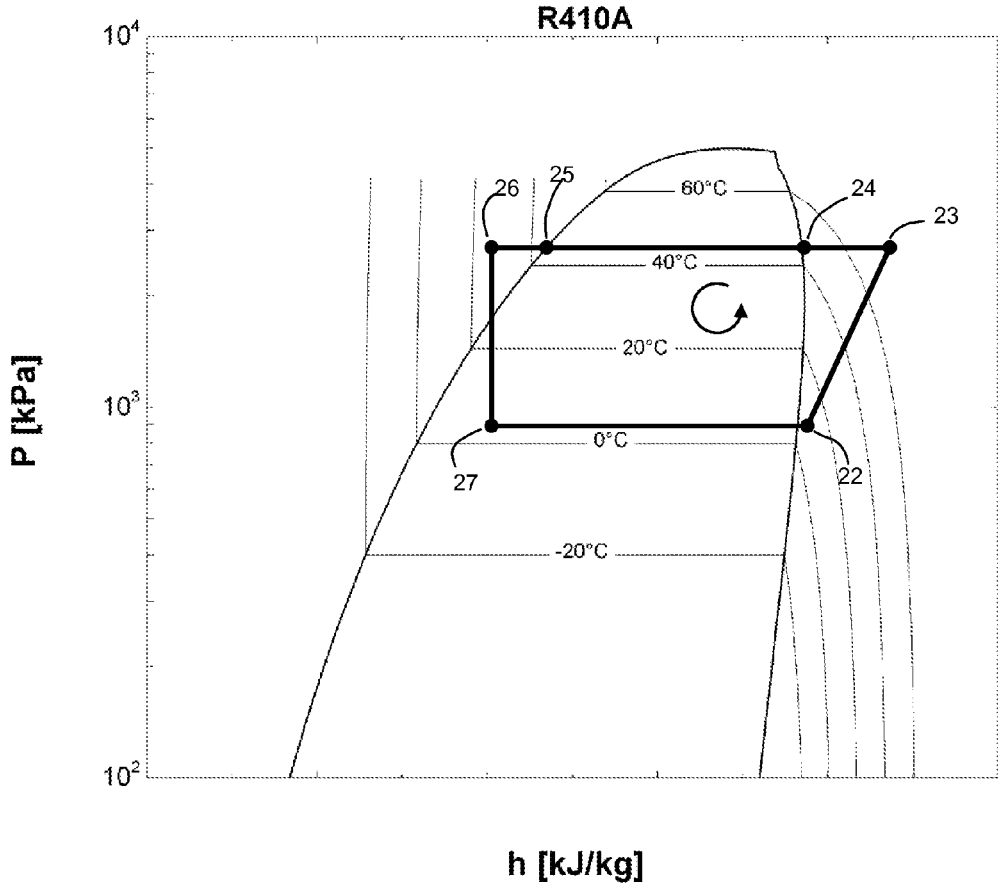
FIG. 2 is a pressure vs. enthalpy graph depicting a typical vapor compression cycle for the system of FIGS. 1*a* and 1*b*.

The thermodynamic cycle of the refrigerant passing through the system 30 in either the air conditioning mode or the heating mode is illustrated in the pressure-enthalpy diagram of FIG. 2. As discussed previously, the refrigerant is compressed from a relatively low pressure superheated vapor state at point 22 to a relatively high pressure superheated vapor state at point 23, is cooled and condensed to a relatively high pressure sub-cooled liquid state at point 26, is expanded to the relatively low pressure two-phase (vapor-liquid) state at point 27, and is vaporized and slightly superheated back to the thermodynamic state of point 22.

The rate at which heat is transferred into the refrigerant in either heat exchanger 1 (in air conditioning mode) or heat exchanger 19 (in heating mode) can be quantified as the refrigerant mass flow rate multiplied by the enthalpy change from point 27 to point 22. Likewise, the rate at which heat is transferred from the refrigerant in either heat exchanger 19 (in air conditioning mode) or heat exchanger 1 (in heating mode) can be quantified as the refrigerant mass flow rate multiplied by the enthalpy change from point 23 to point 26. The heat rejected from the refrigerant includes a sensible vapor portion (corresponding to the enthalpy change from point 23 to point 24), a latent portion (corresponding to the enthalpy change from point 24 to point 25), and a sensible liquid portion (corresponding to the enthalpy change from point 25 to point 26).

Figure 3A:
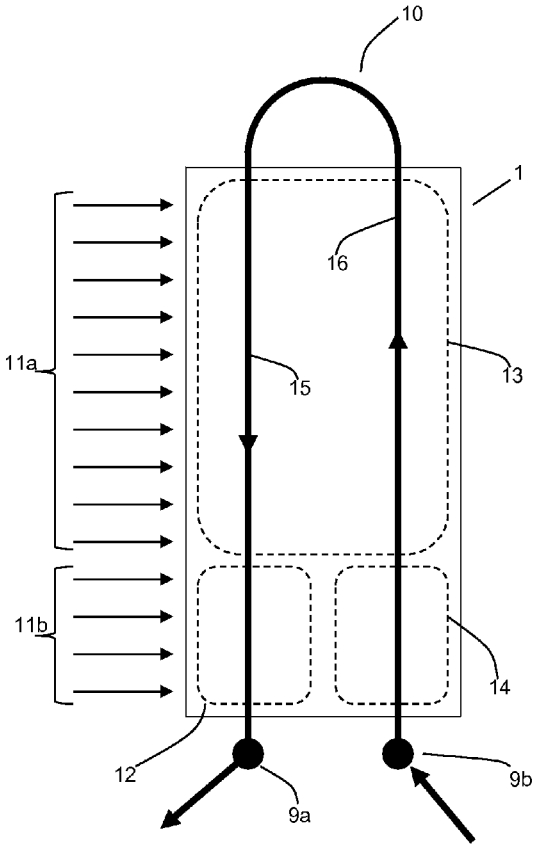
FIGS. 3*a* and 3*b* are diagrammatic illustrations of the fluid flows through a heat exchanger according to some embodiments of the present invention.
Figure 3B:
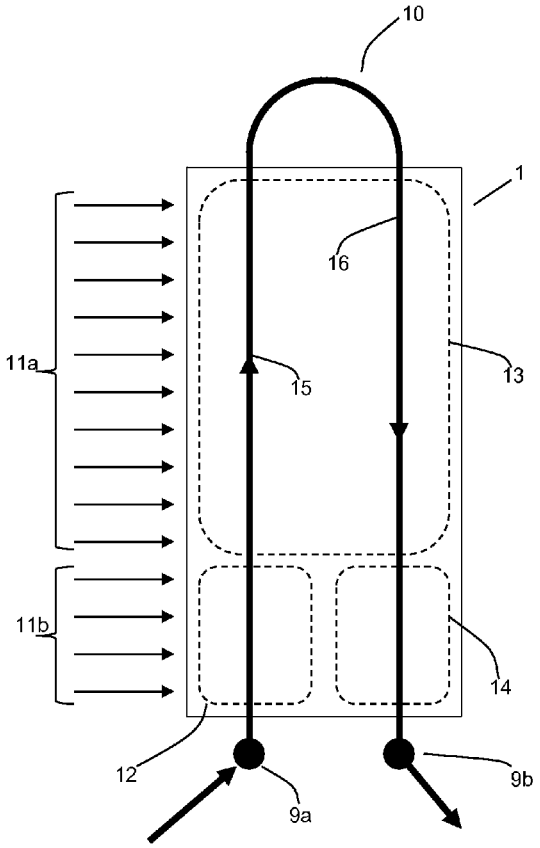

In order to improve the heat transfer performance of the heat exchanger 1, it can be beneficial for the refrigerant flow path 10 to include multiple sequential passes through the flow of air passing through the heat exchanger 1. FIGS. 3*a* and 3*b* illustrate such an arrangement of flow passes for a heat exchanger 1 according to some embodiments of the invention, with the refrigerant and air flows oriented to be in an overall counter flow orientation in FIG. 3*a* and in an overall concurrent flow orientation in FIG. 3*b*.

In the embodiments of FIGS. 3*a* and 3*b*, the heat exchanger 1 includes first and second refrigerant ports 9*a* and 9*b*, with the refrigerant flow path 10 extending between those ports. The refrigerant flow path 10 includes a flow pass 15 connected to the port 9*a* and a flow pass 16 connected to the port 9*b*. A flow of air 11 is directed in cross flow over each of the passes 15, 16 in sequential fashion. In FIG. 3*a*, the refrigerant port 9*b* functions as an inlet port and the refrigerant port 9*a* functions as an outlet port, so that the refrigerant flows first along the pass 16 and second along the pass 15. This is generally referred to as counter flow operation, as the passes are traversed by the refrigerant flow in an order that is opposite of the one in which they are traversed by the air flow. In contradistinction, in FIG. 3*b* the refrigerant port 9*a* functions as an inlet port and the refrigerant port 9*b* functions as an outlet port, so that the refrigerant flows first along the pass 15 and second along the pass 16. This is generally referred to as concurrent flow operation, as the passes are traversed by the refrigerant flow in the same order as they are traversed by the air flow.

As previously indicated, the refrigerant system 30 of FIGS. 1*a* and 1*b* will have refrigerant flowing along the refrigerant flow path 10 in one direction when operating in air conditioning mode, and in the opposite direction when operating in a heating mode. Consequently, the heat exchanger 1 according to the embodiment of FIGS. 3*a* and 3*b* will experience counter flow heat transfer between the air and the refrigerant in one such mode, and concurrent flow heat transfer between the air and the refrigerant in the other such mode.

The inventors have found that operating with counter flow heat transfer in air conditioning mode provides substantial benefits in minimizing the size of the heat exchanger 1 for a given amount of heat duty. Consequently, the heat exchanger 1 is then operated with concurrent flow when the system 30 is in heating mode. This results in the high temperature superheated vapor refrigerant (point 23 on the pressure-enthalpy diagram) entering the refrigerant flow path at the port 9*a*, and the low temperature sub-cooled liquid refrigerant (point 26 on the pressure-enthalpy diagram) exiting the refrigerant flow path at the port 9*b*. Due to the elevated temperature of the refrigerant as it is de-superheated from point 23 to point 24, the portion of the air flow that is in heat transfer with that section of the refrigerant flow path at the beginning of the pass 15 can be heated to a temperature that is too high to effectively sub-cool the refrigerant at the end of the pass 16. Insufficient sub-cooling can lead to, among other things, increased refrigerant mass flow and decreased system efficiency.

In order to avoid the undesirable effects of insufficient sub-cooling in heating mode, the heat exchanger 1 is provided with a first section 12, a second section 13, and a third section 14 along the refrigerant flow path 10. The first section 12 is arranged between the refrigerant port 9*a* and the second section 13, while the third section 14 is arranged between the refrigerant port 9*b* and the second section 16. A portion 11*a* of the air flow is directed through the section 13 and bypasses the sections 12 and 14, while another portion 11*b* of the air flow bypasses the section 13 and is directed first through the section 12 and second through the section 14. The rate of heat transfer between the portion 11*b* of the air flow and the refrigerant in the pass 15 is substantially inhibited in the section 12, so that the temperature of the air 11*b* is maintained at a sufficiently low temperature to enable desirable sub-cooling of the refrigerant in the section 14.

Figure 4:
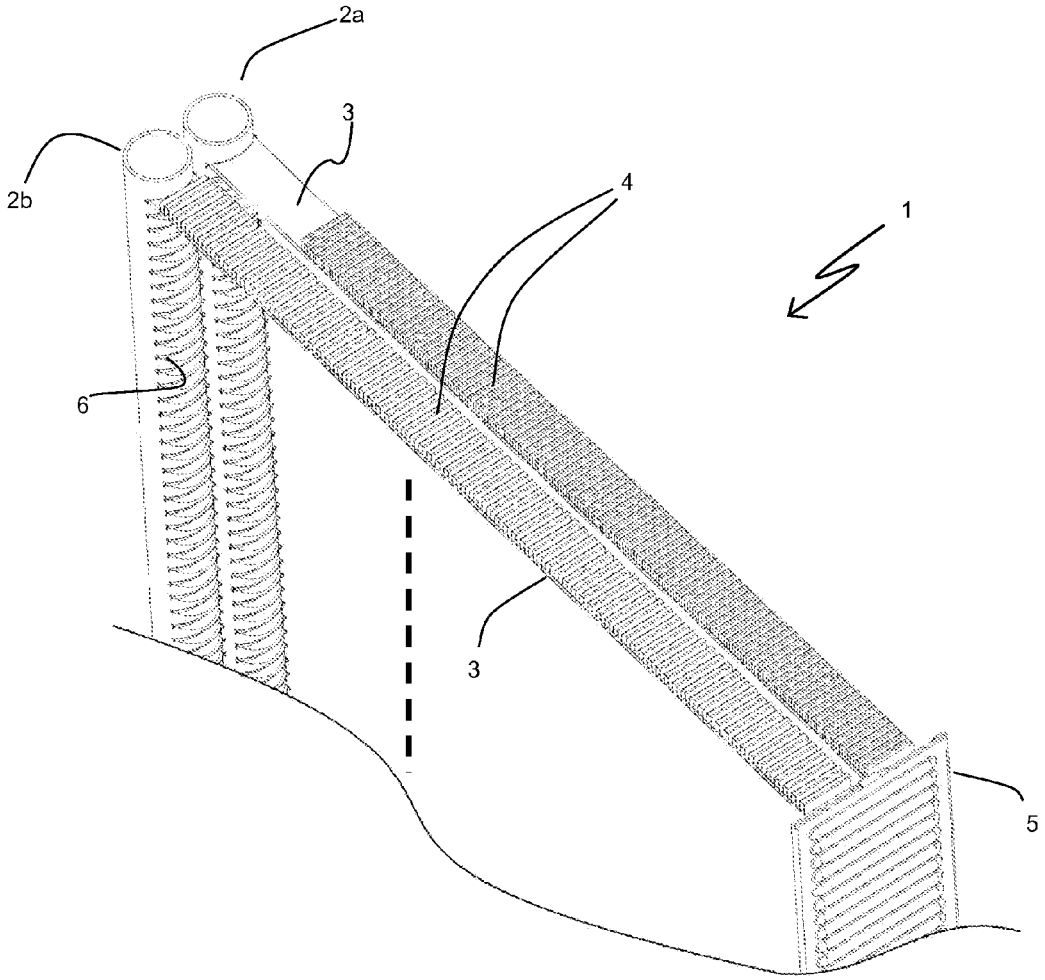
FIG. 4 is a partial perspective view of a heat exchanger according to an embodiment of the present invention.
Figure 5:
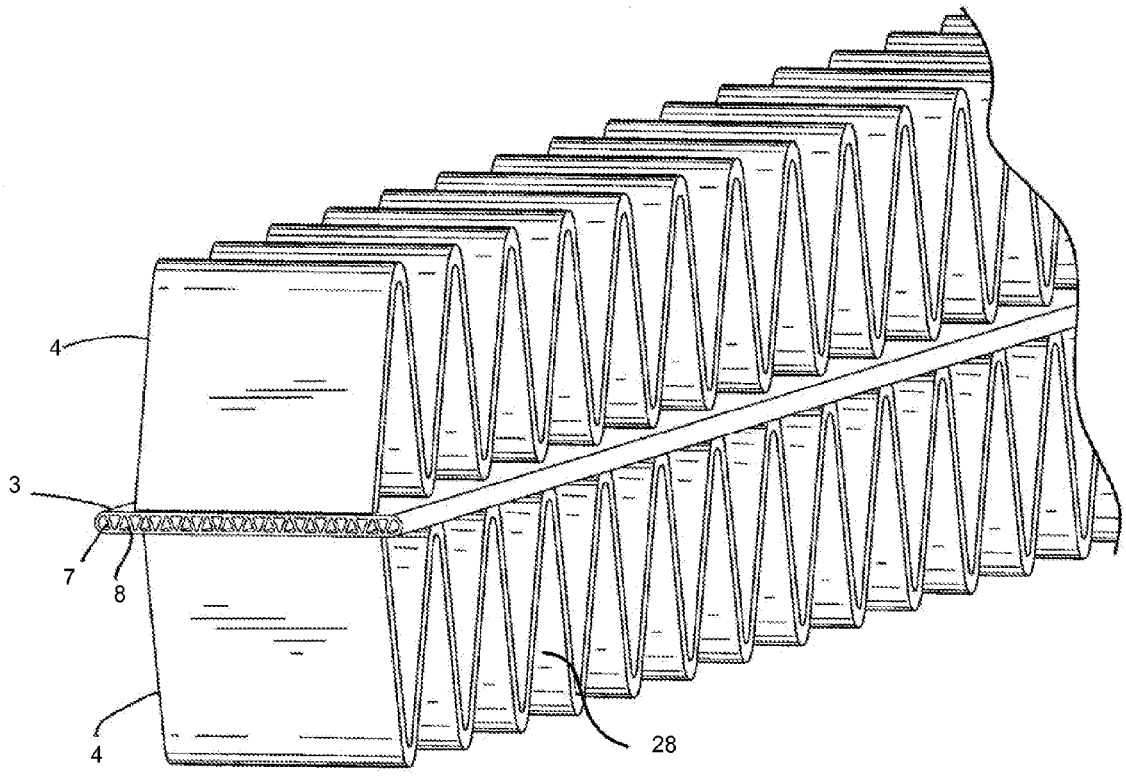
FIG. 5 is a partial perspective view of a tube and fin combination for use in the embodiment of FIG. 3.
Figure 6:
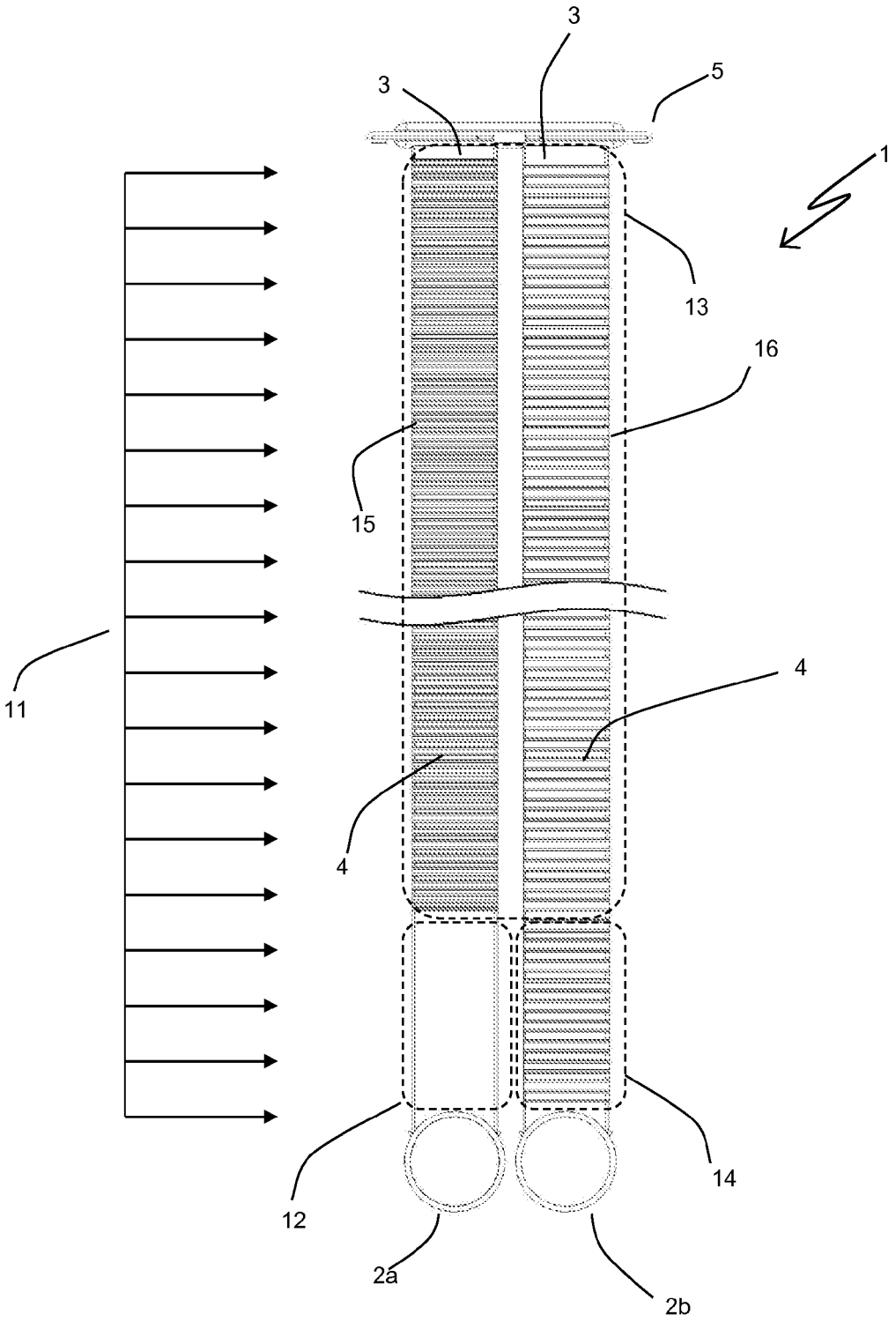
FIG. 6 is a plan view of the heat exchanger of FIG. 4.

Turning now to FIGS. 4-6, an especially preferable embodiment of the heat exchanger 1 will be described. As best seen in FIG. 4, the heat exchanger 1 can include first and second tubular manifolds 2*a*, 2*b*. While not shown in the figures, each of the manifolds 2 can include one of the refrigerant ports 9. The manifolds 2 are arranged at a common end of the heat exchanger 1, while a return manifold 5 is arranged at the opposite end. The manifolds 2 are provided with slots 6 arranged with regular spacing along their length, and flat tubes 3 are received within the slots 6 and extend from the manifolds 2 to the return manifold 5. For clarity, only two flat tubes 3 are shown in FIG. 4, but it should be understood that tubes 3 are provided at each of the slots 6. Convoluted fin structures 4 are disposed against, and joined to, the broad sides of the flat tubes 3 to provide a plurality of flow channels 28 through which air can pass in cross flow orientation to the flat tubes 3. Again, for clarity, only a single layer of the convoluted fin structures 4 are shown in FIG. 4, but it should be understood that the convoluted fin structures 4 are repeated between each set of adjacent flat tubes 3.

The return manifold 5 can be constructed as shown in co-pending U.S. patent application Ser. No. 13/076,607 with inventors in common to this application, the contents of which are incorporated by reference herein. Alternatively the return manifold can be constructed in other ways, such as with an additional pair of tubular manifolds with a fluid connection therebetween. In some embodiments the flat tubes 3 can be long flat tubes with a centrally located bend separating two straight lengths, each straight length being joined to one of the two manifolds 2.

As best seen in FIG. 5, the flat tubes 3 can be provided with internal webs 7 to provide a plurality of micro-channels 8 within each of the flat tubes 3. In some embodiments the heat exchanger 1 can include round tubes in place of flat tubes, and/or plate fins in place of the convoluted fins 4.

Heat transfer between a flow of air passing over the flat tubes 3 and a flow of refrigerant passing through the internal channels of the flat tubes 3 is inhibited in a region 12 immediately adjacent to the manifold 2*a* by the elimination of the convoluted fin structures 4. The plurality of flow channels 28 created by the convoluted fin structures 4 along the remaining length of the flat tubes 3 connected to the manifold 2*a* serve to maintain separation between that portion of the air flow 11 passing through the section 13 and that portion of the air flow 11 passing through the section 12. The portion of the air flow passing through the section 12 is maintained at a relatively unchanged temperature.

A first quantity of heat is removed from the refrigerant as it flows through the section 13 along the first pass 15 to the return manifold 5. A second quantity of heat is removed from the refrigerant as it flows from the return manifold 5 through the section 13 along the second pass 16. The refrigerant next passes through the section 14 to the manifold 2*b*, in heat transfer relationship with the portion of the air flow that passed through the section 12.

As a result of the transfer of the first quantity of heat to the portion of air in the section 13, that portion of the air may be heated to a temperature at which it can condense the refrigerant, but cannot effectively sub-cool it. Consequently, the sum of the first and second quantities of heat corresponds to an enthalpy change of the refrigerant from the point 23 on the pressure-enthalpy diagram to the point 25, so that the refrigerant exits the section 13 as a saturated liquid. Because the air passing through the section 14 has been maintained at a substantially constant temperature, it is cool enough to remove the remaining amount of heat necessary to reduce the enthalpy of the refrigerant from that of point 25 to that of point 26, so that the refrigerant is delivered to the manifold 2*b* as a sub-cooled liquid.

In some alternative embodiments of the heat exchanger 1, a fin structure having a substantially decreased fin density can be provided in the section 12 in place of the un-finned region. In some alternative embodiments a single convoluted fin structure can extend across both rows of the flat tubes 3 in the section 13. In some embodiments the convoluted fin structure 4 in the first pass 15 can have a different fin density than the convoluted fin structure 4 in the second pass 16.

Figure 7:
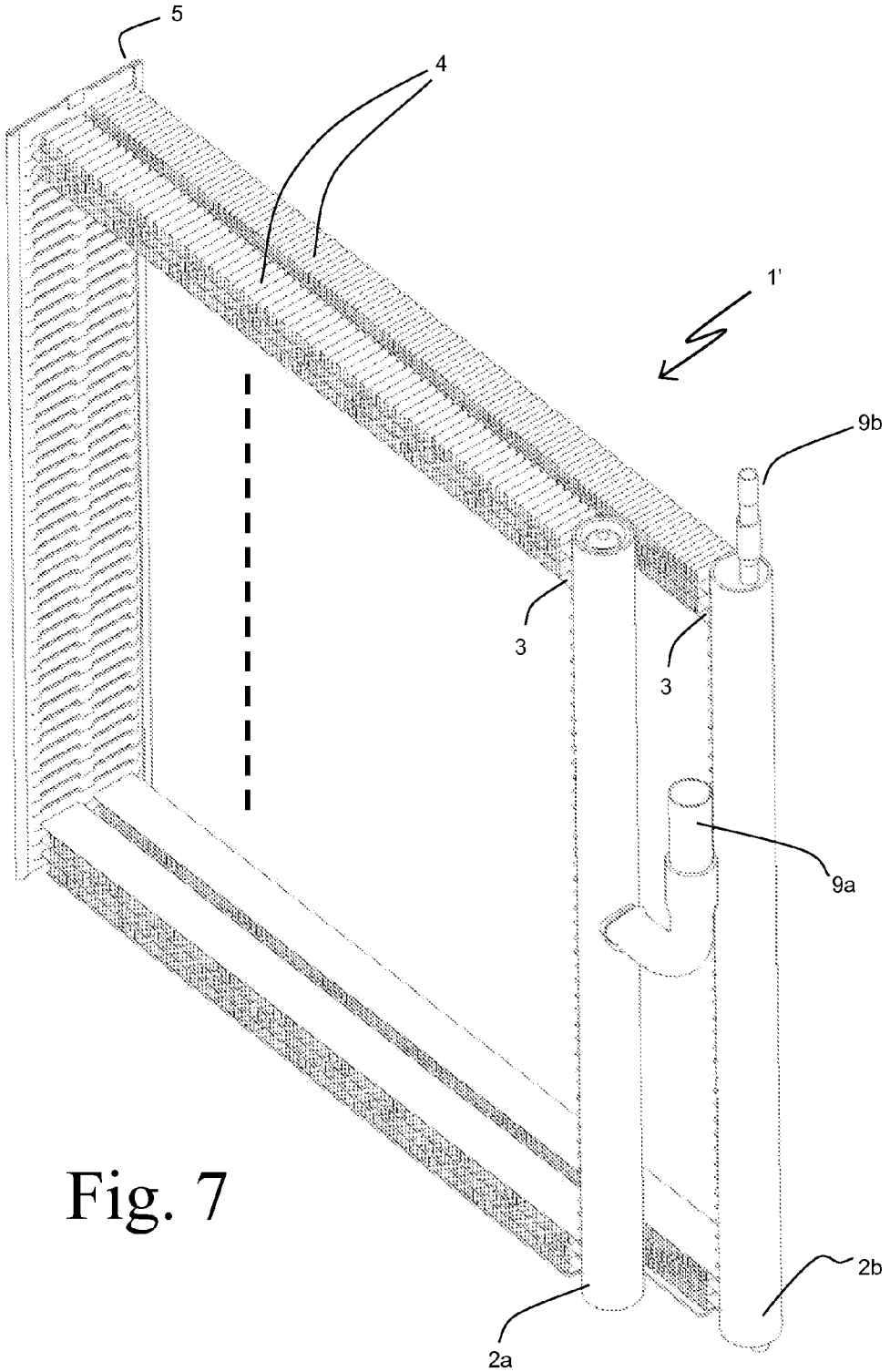
FIG. 7 is a perspective view of a heat exchanger according to another embodiment of the present invention.

An alternative heat exchanger embodiment 1' is shown in FIG. 7. In the embodiment 1', the tubular manifold 2*a* is relocated to provide a separation between the section 12 and the section 13 of the heat exchanger.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

We claim:

1. A heat exchanger to transfer heat between a refrigerant and air, comprising:

a refrigerant flow path extending between a first refrigerant port and a second refrigerant port;

a first section, a second section, and a third section of the heat exchanger arranged sequentially along the refrigerant flow path, the first section arranged between the first refrigerant port and the second section, the third section arranged between the second refrigerant port and the second section;

first and second parallel arranged air flow paths extending through the heat exchanger, the first airflow path extending sequentially through the first section and the third section and bypassing the second section, the second airflow path extending through the second section and bypassing the first section and the third section, wherein heat transfer between the refrigerant and air is substantially inhibited in the first section of the heat exchanger; and a plurality of extended surface features arranged along the first and second air flow paths to promote heat transfer between the air and the refrigerant, said plurality of extended surface features being uniformly distributed throughout the second and third sections, wherein the first section is absent of said extended surface features, wherein the first refrigerant port is positioned a first distance from the second section and the second refrigerant port is positioned a second distance from the second section, and wherein the first distance is substantially the same as the second distance.

2. The heat exchanger of claim 1, wherein the first refrigerant port is operatively coupled to a compressor to receive superheated refrigerant therefrom when the heat exchanger is operated in a heat pump mode.

3. The heat exchanger of claim 1, wherein the refrigerant flow path comprises at least two passes through the second section, refrigerant flowing through said at least two passes in a concurrent-cross flow heat transfer relationship to the air when the heat exchanger is operated in a heat pump mode.

4. The heat exchanger of claim 1, further comprising a plurality of flattened tubes to define the refrigerant flow path in one or more of the first, second, and third section of the heat exchanger.

5. The heat exchanger of claim 4, wherein the refrigerant flow path comprises at least two passes through the second section, the plurality of flattened tubes includes a first plurality of flattened tubes defining one of the at least two passes, and the plurality of flattened tubes includes a second plurality of flattened tubes defining another one of the at least two passes.

6. The heat exchanger of claim 5, wherein the first plurality of flattened tubes further defines the refrigerant flow path in the third section of the heat exchanger.

7. The heat exchanger of claim 6, wherein the second plurality of flattened tubes further defines the refrigerant flow path in the first section of the heat exchanger.

8. A heat exchanger to transfer heat between a refrigerant and air, comprising:

a refrigerant flow path extending between a first refrigerant port and a second refrigerant port;

a first section, a second section, and a third section of the heat exchanger arranged sequentially along the refrigerant flow path, the first section arranged between the first refrigerant port and the second section, the third section arranged between the second refrigerant port and the second section;

first and second parallel arranged air flow paths extending through the heat exchanger, the first airflow path extending sequentially through the first section and the third section and bypassing the second section, the second airflow path extending through the second section and bypassing the first section and the third section, wherein heat transfer between the refrigerant and air is substantially inhibited in the first section of the heat exchanger;

a plurality of extended surface features arranged along the first and second air flow paths to promote heat transfer between the air and the refrigerant; and a plurality of flattened tubes to define the refrigerant flow path in one or more of the first, second, and third sections of the heat exchanger, wherein the first section is absent of extended surface features, wherein the flattened tubes have a planar surface along an entire length of the tube, those portions of the flattened tubes in the second and third sections having said extended surface features joined to the planar surface of the flattened tubes located therein, wherein the first refrigerant flow port is positioned a first distance from the second section and the second refrigerant flow port is positioned a second distance from the second section, and wherein the first distance is equal to the second distance.

9. The heat exchanger of claim 8, wherein the plurality of flattened tubes extend across the second section and the third section, and wherein the first section is absent of flattened tubes.

10. The heat exchanger of claim 9, further comprising a manifold positioned between the first section and the second section, the manifold fluidly coupling the first refrigerant port and the second section.

11. The heat exchanger of claim 8, wherein the first section is free of flattened tubes.

* * * * *